United States Patent [19]

Bertho et al.

[11] Patent Number: 4,907,990

[45] Date of Patent: Mar. 13, 1990

[54] ELASTICALLY SUPPORTED DUAL CANTILEVER BEAM PIN-RECEIVING ELECTRICAL CONTACT

[75] Inventors: Dominique Bertho, Ballysheedy, Ireland; Helen M. P. Dechelette, Paris, France; Eugene J. Mysiak, Lisle, Ill.

[73] Assignee: Molex Incorporated

[21] Appl. No.: 255,001

[22] Filed: Oct. 7, 1988

[51] Int. Cl.[4] ..... H01R 11/22

[52] U.S. Cl. ..... 439/851; 439/856; 439/682

[58] Field of Search ..... 29/874, 747; 439/833, 439/834, 837, 839, 842, 845, 849–857, 885, 682–684

[56] References Cited

U.S. PATENT DOCUMENTS

| | | | |
|---|---|---|---|
| 2,296,632 | 9/1942 | Falge et al. | 439/839 |
| 3,133,780 | 5/1964 | Dean | 439/857 |
| 3,808,578 | 4/1974 | Hansen | 439/857 |
| 4,776,817 | 10/1988 | Jego et al. | 439/833 |

FOREIGN PATENT DOCUMENTS

| | | | |
|---|---|---|---|
| 571898 | 9/1945 | United Kingdom | 439/839 |

*Primary Examiner*—David Pirlot

*Attorney, Agent, or Firm*—Louis A. Hecht; Stephen Z. Weiss

[57] ABSTRACT

A high contact force, high elastic response range pin-receiving electrical contact is provided in a pin-receiving contact including a base portion and a pair of spaced apart cantilever beams which extend forwardly from the base to a pin-receiving end. A pair of inwardly directed contact surfaces are defined on each cantilever beam facing the opposed beam for slideably, electrically engaging an inserted pin terminal. In accordance with the invention, a resilient beam support member extends from and interconnects the pin-receiving ends of the cantilevered beams. The resilient beam support member provides a significantly improvement in the elastic response range of the pin-receiving contact by enabling each cantilevered beam to endure a greater outward displacement before a minimum yield in the beam occurs while providing a greater normal force against the pin. In a preferred embodiment, the resilient beam support member is a planar U-shaped spring which extends parallel to and adjacent the cantilevered beams and extends rearwardly from the front pin-receiving end of the contact.

8 Claims, 7 Drawing Sheets

PRIOR ART

ELASTICALLY SUPPORTED DUAL CANTILEVER BEAM PIN-RECEIVING ELECTRICAL CONTACT

BACKGROUND OF THE INVENTION

The present invention relates to metallic terminals for electrically connecting pin terminals with another circuit member. More particularly, it relates to a new and improved pin-receiving contact structure including resiliently supported contact beams which provide a pin-receiving contact section characterized by high normal forces and a significantly increased elastic deflection range.

Electrically mateable connectors including mateable pin and receptacle contact terminals are widely used in a variety of forms throughout the electronics field for electrically connecting two or more circuit members to each other. Illustrative interconnect applications employing mating pin and receptacle contacts include board-to-board, wire-to-board, cable or FFC-to-board, cable-to-cable, discrete wire-to-discrete wire, discrete wire-to-FFC or cable, component-to-component, and component to board connections.

Recent developments in the field of electronics, and electrical devices and appliances in general, now require electrical interconnection manufacturers to provide compact, more miniaturized connectors having higher circuit densities. Present-day design requirements for miniaturized connectors are testing the limits of a manufacturer's ability to mold plastics and stamp and form metals. In addition to the design pressure for miniaturization, the marketplace now demands high quality connection products having extended use lives to be provided with zero defects on a just-in-time delivery schedule. As a result, the connection manufacturer must consider manufacturability issues in designing products.

New products must now be designed so that they may be reliably manufactured at the lowest limits of manufacturing tolerances and, if certain aspects of a design cannot be held to a desired tolerance, then other aspects of the design must accommodate these production realities. Price competition in this market is intense.

These modern design pressures are especially applicable to mating pin and receptacle terminals and connectors. As used herein what is meant by a miniaturized pin-receiving contact is a receptacle contact designed to mate with a rectangular or round pin terminal having a width or diameter of less than about 0.030 inches (e.g. less than 1.0 mm). The pin-receiving contact section may include contact beams having a beam length of less than about 0.120 inches (e.g. less than about 4 mm) and having a beam width of less than about 0.050 inches (e.g. less than about 1 mm).

In addition to these stringent size limitations, miniature connectors are now required for mating with high density multicircuit pin arrays wherein the centerline spacing between adjacent pins is extremely small, i.e. less than about 0.100 inches and often as low as 0.050 inches. Moreover, each pin-receiving contact, even in view of its miniature size and spacing requirements, may now be required to exert normal mating contact forces of greater than 50 grams per contact and preferably at least about 75 to 100 grams per contact. Each contact may also be required to withstand repeated mating and unmating operations without yielding or losing normal contact loads over time. Finally, each contact in addition to providing high contact forces may also be required to be compliant to manufacturing tolerances and mating pin misalignments.

Prior art miniature pin-receiving contacts are known and commercially important examples are shown in FIGS. 1-3, prior art, of the attached Drawings. FIG. 1 shows a conventional miniature pin-receiving contact commonly referred to as a tuning fork type contact. This prior art contact generally comprises a planar stamped metallic contact including a base portion and a pair of parallel, spaced cantilevered spring arms extending from the base. Pin-receiving contact surfaces are defined on the opposing inner facing surfaces of each beam adjacent their free ends to define an early entry pin-receiving contact. Early entry contacts are desirable to provide longer wipe of the female contacts against the pin surfaces during insertion of the pin for improved contact reliability.

Tuning fork contacts of the type shown in FIG. 1, are adapted to receive square or rectangular pins only and therefore may not be used with round pins. Although the tuning fork contacts may provide a desirably high spring rate per beam, the elastic deflection range of the contact is undesirably low. For this reason, the tuning fork contact is very sensitive to mating misalignments. Even minor offsets in pin placement during mating may cause displacement of a contact beam exceeding its elastic deflection range, thereby causing yield in the beams introducing a new permanent set in the terminal which results in lower normal contact forces.

In an effort to improve the compliance of the contact to overstressing and misalignments, thinner metal stock has been used to improve the elastic deflection range of the contact beams. This change however reduces the effective spring rate of each beam which compromises the normal mating contact load of the tuning fork against the pin. To improve the spring rate and elastic deflection range of the tuning forks, manufactures have stamped the terminals from higher grade stock such as beryllium copper and specially heat-treated or tempered beryllium copper stock. These higher grade sheet metal stocks are generally seven times more expensive than lower grade phosphor bronze stocks and, if additional heat treating steps are required, the cost may be increased even further. Often, even after changing to higher grade stocks, the resulting contact still may not provide desired spring rate and elastic deflection range to meet modern design criteria and larger contact sizes and spacing must be used.

A second conventional type of miniature pin-receiving contact, known as a dual cantilevered spring arm type, is shown in FIG. 2. This prior art contact is capable of electrically mating with rectangular or round pins and is also of an early entry type. The contact is generally characterized by low or moderate normal contact force loads and by a medium elastic deflection range. Although this pin-receiving contact structure is versatile and useful and exhibits a larger elastic deflection range than a tuning fork-type contact, the elastic deflection range is still too small for many modern design requirements. As was the case with the tuning fork, efforts to improve the elastic deflection range of the dual cantilever beam type contacts have included stamping from thinner gauge stock, which compromises the spring rates achievable for each beam, or moving to higher quality stocks which drastically increases the cost of each contact.

Still another prior art miniature pin-receiving contact is shown in FIG. 3. This contact may be referred to as a dual supported beam contact. The dual supported beam contact shown is a relatively late-entry pin-receiving contact as compared with the two early entry contact structures mentioned above. The FIG. 3 contact is generally characterized by high contact forces and very low elastic deflection range. The dual supported beam is relatively easily overstressed and is very sensitive to mating pin misalignments. Efforts to improve the elastic deflection range of the contact to provide a more compliant pin-receiving terminal have included changing to beryllium copper sheet stock with a very large increase in expense and only minor expansion of the elastic deflection range.

In order to remedy the deficiencies of the prior art pin-receiving contacts, it is an object of the present invention to provide a new and improved pin-receiving electrical contact characterized by high normal contact forces and exhibiting a significantly improved elastic deflection range.

SUMMARY OF THE INVENTION

In accordance with this and other objects, unexpectedly it has now been discovered that a very high contact force, very high elastic deflection range pin-receiving contact is provided in a pin-receiving contact including a base and a pair of spaced cantilevered beams, each extending forwardly from the base to a pin-receiving end. Each beam includes a contact surface defined thereon facing the opposed beam, for slideably, electrically engaging an inserted pin terminal. In accordance with the present invention, the pin-receiving contact terminal comprises a resilient beam support member, extending from and interconnecting the pin-receiving ends of the beams.

The resilient beam support member is effective to significantly increase the elastic response range of each beam to a greater outward displacement while providing a greater normal force against the pin. In comparison with a substantially identical contact which does not include the beam support member, the contacts of this invention exhibit an effective spring rate per beam which is the same or is increased and the elastic deflection range of each beam is significantly increased. Accordingly, the new and improved elastically supported pin-receiving contacts of this invention are able to develop high normal contact loads against a mated pin terminal in use without introducing yield in the contact. Moreover, the increased elastic deflection range for the contact now provides a very high normal force and substantially compliant pin-receiving terminal which can accommodate a broad range of manufacturing tolerances and/or mating pin terminal misalignments.

In a preferred embodiment, the new and improved high-contact force, high elastic deflection range pin-receiving electrical contact includes a base which is generally U-shaped including a pair of legs upstanding from a bight portion. Each of the cantilevered contact beams extend forwardly from the upstanding legs of the base portion of the terminal. Also in the preferred embodiment, the beam support member comprises a U-shaped spring element including a bight portion and a pair of spring arms which extend from the bight portion to an opposed end. The opposed ends of the beam support member spring arms are connected in tandem to the pin-receiving ends of the cantilevered contact beams by means of a pair of L-shaped linking elements.

In this preferred embodiment, the resilient beam support member may extend rearwardly from the L-shaped linking members toward the base of the pin-receiving contact in a plane extending generally parallel to the cantilevered contact beams and perpendicular to the legs of the base.

In this preferred embodiment, the resilient beam support member can extend on an upper or lower side of the pin-receiving contact defined by the cantilevered beams without significantly increasing the overall size of the pin-receiving contact. The effective spring rate of each beam and the elastic deflection range of the pin-receiving contact are both generally increased and further may generally be said to exhibit combined mating characteristics of both the dual cantilever beams as well as the resilient support member.

The new and improved pin-receiving electrical contact structure is especially well-suited for miniature pin-receiving electrical contacts. The contact performance advantages in terms of improved spring rate coupled with a significantly increased elastic deflection range, now permit ultra-high contact forces to be developed with a stamped and formed pin-receiving contact than was heretofore considered possible to achieve. The improved contact performance coupled with its remarkable insensitivity to mating misalignments provides the design engineer with greater flexibility or leeway with respect to manufacturing tolerances encountered with other aspects of the interconnect design, such as tolerances with respect to terminal position within a housing and with respect to mating housings per se.

Another important advantage provided by the new and improved elastically supported dual cantilever beam contact structure of the present invention is that the contact may be used to provide miniature pin-receiving contacts which are stamped and formed from lower grade phosphor bronze sheet metal stocks and which exhibit superior properties at a significantly reduced cost per contact.

In an alternate aspect, the present invention provides a method for making new and improved high-contact force, high elastic deflection range pin-receiving electrical contacts, including the steps of stamping and forming, a pin-receiving contact section including a base and a pair of spaced apart cantilevered beams extending forwardly from the base to a pin-receiving end, and the addition in said stamping and forming steps of providing a resilient beam support member extending from interconnecting the pin-receiving ends of said beams to thereby increase the elastic response range of the formed contact to a greater outward displacement, while providing greater normal contact forces against an inserted pin.

Other objects and advantages of the present invention will become apparent from the following Detailed Description taken in conjunction with the Drawings in which:

DETAILED DESCRIPTION OF THE PREFERRED EMBODIMENT

Figure 4:
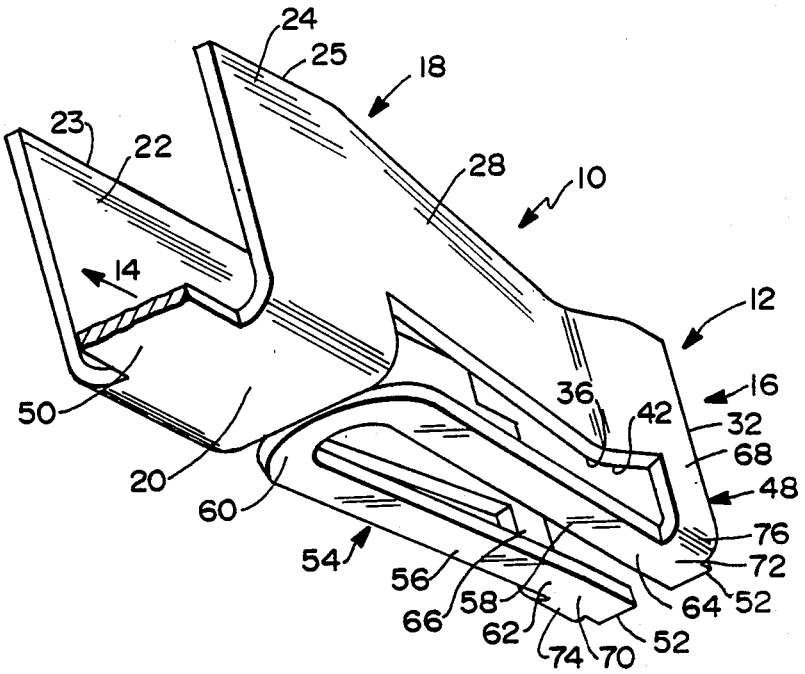
FIG. 4 is a rear perspective view of the preferred elastically supported dual cantilever beam pin-receiving electrical contact of the present invention.
Figure 5:
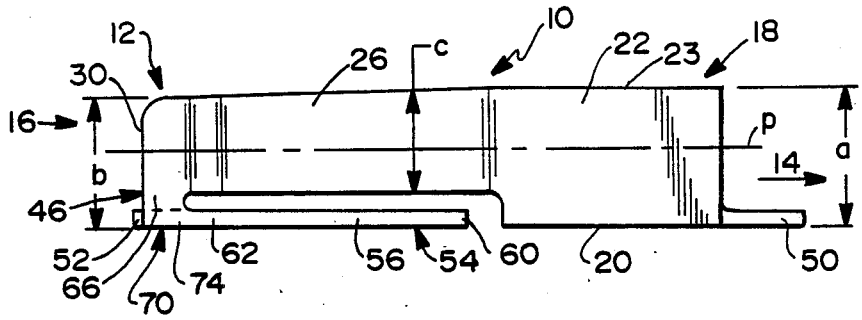
FIG. 5 is a side elevation view of the preferred embodiment of the new and improved elastically supported dual cantilever beam pin-receiving electrical contact of the present invention.
Figure 6:
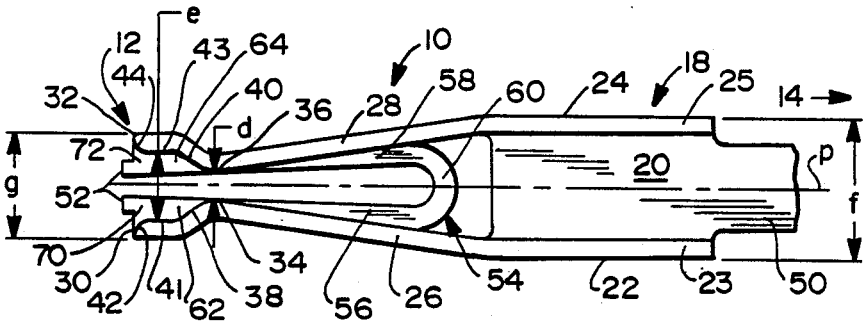
FIG. 6 is a top plan view of the preferred new and improved elastically supported dual cantilever beam pin-receiving electrical contact of the present invention.

Referring now to FIGS. 4–6, an integral, unitary metallic terminal, generally referred to by reference numeral 10, is shown. Terminal 10 is stamped and formed from sheet metal stock to define an elongate electrical terminal including a front end 12 and an opposed rear end 14 (not shown). The new and improved elastically supported dual cantilever beam pin-receiving contact of this invention, generally designated by reference numeral 16, is provided adjacent front end 12 of terminal 10.

In the preferred embodiment, the new and improved pin-receiving contact 16 is shown to include a base portion 18. Base portion 18 has a generally U-shaped configuration including a flat or horizontal bight portion 20 and a pair of spaced apart upstanding legs 22 and 24. Each of legs 22 and 24 extends from opposed sides of bight portion 20 to an upper free end, shown as ends 23 and 25, respectively.

The new and improved pin-receiving contact 16 further includes a pair of cantilevered contact beams 26 and 28 extending forwardly from base portion 18 to front end 12. More particularly, in the preferred embodiment shown in FIGS. 4–6, cantilevered contact beam 26 extends forwardly from leg 22 adjacent upper end 23 to a front pin-receiving end 30. Cantilevered contact beam 28 extends forwardly from leg 24 adjacent upper end 25 thereof to a front pin-receiving end 32. An inwardly directed or facing convex contact surface 34 and 36 is defined along each of beams 26 and 28, respectively, adjacent their respective pin-receiving ends 30 and 32. Each beam 26 and 28 is further provided with an outwardly flaring anti-stubbing pin guide surface 38 and 40, a generally straight-sided pin mouth surface portion 41 and 43, and a radiused or tapered surface 42 and 44 at each end 30 and 32, respectively.

As shown in the preferred embodiment illustrated in FIGS. 4–6, a pair of mirror image L-shaped linking members 46 and 48 extend generally perpendicularly downwardly from cantilevered beams 26 and 28 adjacent their pin-receiving ends 30 and 32, respectively. Each L-shaped linking member is shown to respectively include a vertical segment 66 and 68 and a horizontal segment 70 and 72 and a rounded approximately right angle bend 74 and 76 therebetween. A pair of carrier attachment projections 52, are shown extending forwardly from horizontal segments 70 and 72 which are useful during forming operations in making the new and improved contact 16.

In accordance with the present invention, the mechanical and electrical performance of pin-receiving contact 16 is improved because a resilient beam support member 54 extending from and interconnecting the pin-receiving ends 30 and 32 of beams 26 and 28 is provided. In the preferred embodiment depicted in FIGS. 4–6, resilient beam support member 54 has a generally planar U-shaped configuration and extends generally parallel to and below cantilevered contact beams 26 and 28. More particularly, resilient beam support member 54 includes a pair of arms 56 and 58 each interconnected at a first end by a rounded bight portion 60 and extending to an opposed end 62 and 64 which is connected to horizontal segments 70 and 72 respectively. Resilient beam support member 54 may be considered as a resilient system which is connected in tandem to the pin-receiving ends 30 and 32 of cantilevered contact beams 26 and 28.

As shown in FIGS. 4–6, metallic terminal 10 may also include a rear end 14 (not shown) extending rearwardly from a terminal transition portion 50 which extends rearwardly from the bight portion 20 of base 18. As will be apparent to those skilled in this art, terminal 10 may include another electrical contact portion for connecting a pin terminal mateably engaged in pin-receiving contact portion 16 to another circuit member. Illustrative examples of second contact portions extending from transition portion 50 may include, without limitation: crimp, insulation-displacement, solder tail and surface mount contact portions.

In greater detail and referring now to FIG. 5, the new and improved pin-receiving contact structure 16 generally includes an upper pin-receiving portion comprising the base 18 and the cantilevered contact beams 26 and 28 and a lower elastic support portion including resilient beam support member 54 and linking elements 46 and 48. The pin-receiving portion of contact portion 16 includes a longitudinally extending pin-receiving axis, p, which is disposed in an upper half of pin-receiving contact 16 as shown. The elastic support portion of contact 16 is shown spaced from and below the pin-receiving portion. Advantageously, as shown in FIG. 5, the height, a, of base portion 18 is greater than the height, b, of the front end 12 to provide easier insertion of the pin-receiving contact 16 of terminal 10 into a terminal receiving cavity of a connector housing, as will be more fully discussed below. Accordingly, the width dimension, c, of each cantilevered beam 26 and 28 will be gradually tapered or reduced along the length of the beam extending between the base 18 and pin-receiving ends 30 and 32. As is apparent from the preferred embodiment shown is FIG. 5, the resilient beam support portion 54 may be included in pin contact section 16 without increasing the overall height of the contact section 16.

Referring now to FIG. 6, pin-receiving contact 16 is shown to be generally balanced and symmetrical about its pin-receiving axis, p. The opposing convex contact surfaces 34 and 36 define an early entry pin-receiving contact section adapted to slideably receive and electrically engage an inserted rectangular or round pin terminal. An initial contact gap, d, is provided therebetween which is smaller than the cross sectional diameter or width of an inserted round or rectangular pin terminal. The opposing straight sided pin mouth surface portions 41 and 43 are separated by a gap, e, which is greater than the cross sectional width or diameter of the pin to ensure that the opposed side surfaces along the front end of an inserted pin terminal engage the front ends of cantilevered beams 26 and 28 along anti-stubbing tapered lead in surfaces 38 and 40. The configuration of anti-stubbing surfaces 38 and 40 also directs the front end of an inserted pin between contact surfaces 34 and 36 and assists in cammingly deflecting cantilever beams 26 and 28 outwardly during pin insertion.

Moreover, as shown in FIG. 6, the overall width of pin-receiving contact 16 defined along base 18 indicated by dimension, f, is preferably larger than the front end width, g, defined between the outer surfaces of vertical segments 66 and 68 of L-shaped linking members 46 and 48. As shown in the preferred embodiment in FIG. 6, the provision of the performance improving resilient beam support member 54 in pin-receiving contact 16 does not disadvantageously require an increase in the width of the overall contact 16. The reduced width, g, of the front end 12 relative to width, f, of the base 18 of contact 16 also contributes to the tapered front end 12 of terminal 10 to facilitate insertion of terminal 10 into a housing cavity of an electrical connector. The reduced dimensions b and g of front end 12 are also provided to leave clearance for contact deflection in a manner to be described below.

As has been mentioned above, the new and improved elastically supported dual cantilever beam pin-receiving contact 16 of the present invention provides a contact structure generally characterized by retained or improved spring rate per beam and a significantly improved elastic deflection range, as compared to a substantially identical contact which does not include a resilient beam support member, such as beam support member 54 shown in FIGS. 4–6.

The performance advantages provided by the new and improved pin-receiving contact may be more fully appreciated from a working example. By analyzing the contact configuration of the present invention against the prior art contacts shown in FIGS. 1–3, in an actual contemporary miniature pin-receiving connector design context, the advantages of the new and improved pin-receiving contacts, such as contact 16 are presented in high-relief.

In this working example, a valued customer has requested a product design be prepared for a miniature pin-receiving connector adapted for robotic assembly on a printed circuit board. The customer has specified that the pin-receiving contact must be able to withstand life cycle testing including 500 mating/unmating cycles at 10 to 20 cycles per minute without any degradation in mechanical properties. The customer has also required each contact to develop or apply at least about 80 grams of normal contact force against the pin in fully mated condition and preferably up to 100 grams or more per contact (3.5 oz.).

In the conditions set out by the customer, the pin-receiving contact must have contact beams having a maximum length of 0.114 inches and a beam width of about 0.040 inches. From the parameters set out by the customer it is clear that the pin-receiving contact configuration chosen must develop the minimum required normal force load, i.e. 80–100 grams per contact under nominal or minimal conditions and be sufficiently compliant to elastically, resiliently respond to repeated mating under maximum or worst case mating conditions in view of the life cycle test requirements.

In this example, the minimum condition for mating is defined for that condition wherein the pin-receiving contact axis, p, is aligned with the longitudinal axis of the pin terminal. Moreover, the smallest dimensioned pin which may be encountered due to manufacturing tolerances is mated with a pin-receiving contact having a contact gap, d, which is at the widest separation that would be encountered due to manufacturing tolerances. Under the defined minimum mating conditions, therefore, the contact beams of the pin-receiving contact will be outwardly displaced the smallest amount upon mating with the pin.

From the customer's specifications, given a 0.022 inch diameter pin terminal and a contact gap of 0.016 inch, and considering manufacturing tolerances, it is determined that the minimum outward displacement of each contact beam under the minimum mating conditions is 0.004 inch. Given the customer's requirement that the contact achieve a normal contact load of at least 80 grams per beam, it is calculated that each beam must have an effective spring rate of at least 20 grams per 0.001 inch, because under the minimum mating condition of 0.004 inch displacement, the mated contact must generate the required minimum 80 grams load. (20 gms/0.001″×0.004″=80 grams.)

After further study of the customer's design criteria, it is determined that a maximum condition in mating would occur if pin misalignment and all tolerance variations acted against one beam of the contact. The worst case would arise when misalignments due to tolerances are all offset in the same direction away from one side of the pin-receiving axis of the contact. More particularly, the maximum condition occurs when the contact has the narrowest gap, d, and the pin dimensions are the largest they can be and all position tolerances work against the contact beam, i.e. the pin axis is offset from the pin-receiving axis the largest amount. Under these maximum conditions it is determined that the contact may encounter an outward mating displacement on one beam of 0.010 inches.

The pin-receiving contact configuration is therefore required to have an elastic response range upon mating with a pin terminal of up to 0.010 inch per beam. Expressed differently, each contact beam must be able to withstand an outward deflection of at least 0.010 inch without yielding. Its deflection to minimum yield value must be greater than or equal to 0.010 inches. As always, the customer expects the lowest price possible.

Figure 1:
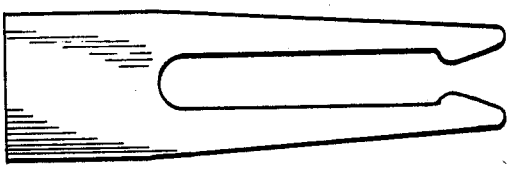
FIG.1 PRIOR ART
FIG. 1 is a plan view of a prior art tuning fork type pin-receiving electrical contact.
Figure 2:
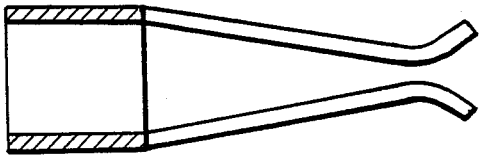
FIG.2 PRIOR ART
FIG. 2 is a top plan view, partly in section, of a prior art dual cantilever spring beam pin-receiving electrical contact.
Figure 3:
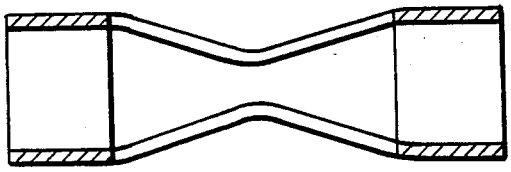
FIG. 3 is a top plan view, partly in section, of a prior art dual supported beam pin-receiving electrical box contact.

The elastic deflection range for each of the prior art contacts shown in FIGS. 1–3 and the new and improved pin-receiving contact 16 shown in FIGS. 4–6 was calculated and compared using a beam length of 0.114″ and a beam width of 0.040 inches for each. The material selected was a phosphor bronze stock having a minimum yield of 92,000 psi. For each contact configuration an average acceptable thickness of stock as may be used commercially was specified. The spring rate of each beam and the deflection to minimum yield for each beam of each contact configuration was calculated in accordance with known formulas. The results obtained are set forth in the following table:

TABLE 1

CALCULATED SPRING RATE AND DEFLECTION @ $YIELD_{min}$ BY CONTACT CONFIGURATION

| CONTACT TYPE | THICKNESS (inches) | SPRING RATE (gms/.001 inch) | DEFLECTION @ $YIELD_{min}$ (inches) |
|---|---|---|---|
| Tuning Fork (FIG. 1) | 0.015 | 60 | .003 |
| Dual Beam (FIG. 2) | 0.010 | 49 | .005 |
| | 0.0074 | 20 | .007 |
| Dual Supported Beam (FIG. 3) | 0.003 | 20 | .004 |
| This Invention (FIG. 4–6) | 0.008 | 29 | .010 |
| | 0.007 | 20 | .009 |

The results of Table 1 show that for this customer's design criteria in this working example, the tuning fork type prior art contact of FIG. 1, is predicted to yield even under minimum mating conditions, and is therefore unsuitable. The prior art dual supported beam contact of FIG. 2 is predicted to have a good contact load generating ability but has an elastic deflection range which is too narrow to satisfy the maximum conditions. This contact configuration also does not meet the customer's design requirements.

The prior art dual supported beam contact shown in FIG. 3, even in a very thin specified sheet thickness was predicted to yield at or about the minimum condition and therefore did not have the specified elastic response range required.

Only the new and improved pin-receiving contact 16 of the present invention, as shown in FIGS. 4–6, was predicted to provide the required elastic response range of between 0.004 and 0.010 inch inclusive, without yielding and provide a normal contact force load of at least about 80 grams per beam, for the phosphor bronze material specified.

Preliminary product testing for the preferred terminal of this invention has confirmed these calculated values. The product tested having the configuration shown in FIGS. 4–6 and dimensioned as set forth in this example for 0.008 material thickness, generated the required minimum normal force of 80 grams at a displacement of 0.004 inches and after being subjected to step-wise increasing outward displacements, this contact did not begin to yield until the displacement was greater than 0.010 inches.

In addition, the contact of the present invention was analyzed by Finite Element Method (FEM) analysis and the results of that study indicated that the elastically supported dual cantilever beam contact 16 of this invention had an elastic response range broad enough to accommodate all misalignments due to manufacturing tolerances and still provide the desired normal contact forces required by the customer.

The advantage of the tandem spring receptacle contact design of this invention as shown in FIGS. 4–6 is that one spring assists another spring to achieve the overall mating properties required. The preferred embodiment design of this invention (FIGS. 4–6) may be considered as a combination of the dual cantilever beam contact of FIG. 2 connected in tandem to a tuning fork type contact as shown in FIG. 1. Table 1 shows that each of these spring contact types are unsatisfactory or too weak by themselves to provide the properties required. However, when the two contact types are structurally combined in accordance with the teachings of this invention into a single contact system, a pin-receiving contact having a significantly improved elastic response range and characterized by high normal contact forces is provided.

More particularly, as shown in Table 1, the contact of this invention at 0.007 inch thickness provided a 29% improvement in the elastic response range over the FIG. 2 contact at 0.0074 inch thickness. The contact of this invention at 0.008 thickness provided a 49% improvement in elastic response range as compared with the same closest prior art terminal.

In addition, only the contact 16 configuration of the present invention was expected to provide the required mating properties using the lower cost grade phosphor bronze stock specified. Prior art contacts shown in FIGS. 1–3 would have to be stamped out of beryllium copper stock, which is about seven times more expensive to use than phosphor bronze to achieve performance characteristics approaching those achieved by the contact 16 of this invention.

In the alternative, similar properties using the prior art contacts might also be achievable if the dimensions of the contact beams were increased. Applicants' design achieved superior properties using less material, and lower cost materials, than was expected to be obtained from the prior art configurations shown in FIGS. 1–3. Again, early product testing of applicants' contact, FIGS. 4–6, has confirmed that actual performance corresponds with the calculated properties set forth in Table 1.

Figure 7:
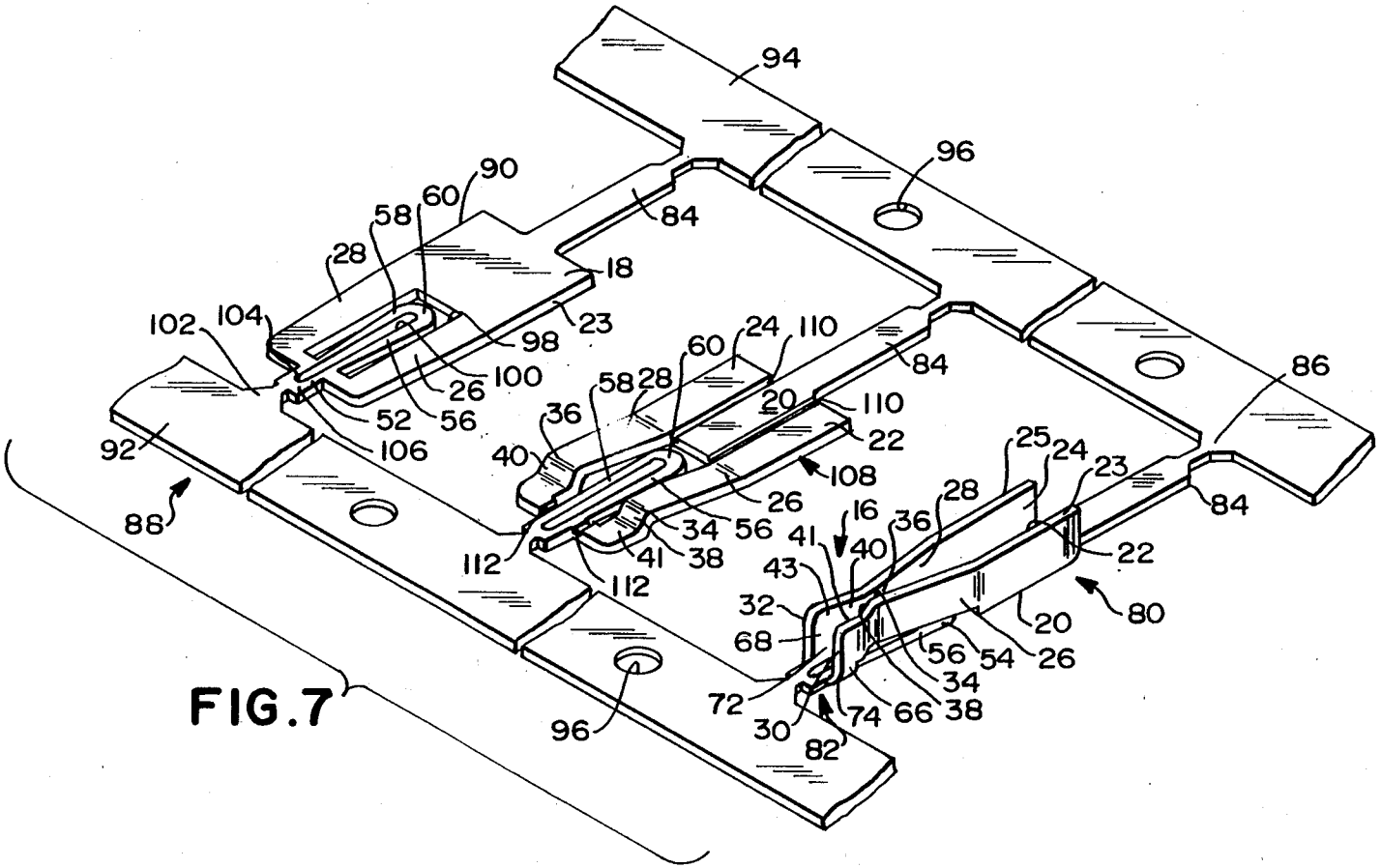
FIG. 7 is a perspective view of a terminal blank containing the new and improved preferred pin-receiving electrical contacts of this invention supported on a dual carrier system and illustrating various steps in the method of forming the new and improved contact of this invention.

Referring now to FIG. 7, a preferred method for making the new and improved terminals 10 including pin-receiving contact 16 of this invention, is illustrated. More particularly, the steps for making a pin-receiving terminal 80 are shown. Pin-receiving terminal 80, shown at the right hand portion of FIG. 7, is adapted to electrically connect a pin terminal to a conductive region defined on a printed circuit board. Terminal 80 includes the new and improved pin-receiving contact 16 at a front end 82 and a solder tail contact portion 84 defined at the other end 86.

As shown in FIG. 7, terminal 80 is stamped from sheet metal stock to form a carrier assembly 88 including a terminal blank 90 defined and extending perpendicularly between a parallel spaced pair of carrier strips 92 and 94. Carrier strips 92 and 94 are provided with spaced apart pilot holes 94 defined therein for feeding or advancing the carrier assembly 88 through the stamping and forming equipment.

In accordance with the method of this invention, the resilient support member 54 is advantageously stamped out of the stock at the same time the base 18 and cantilever beams 26 and 28 are stamped and defined in blank. More particularly, the blank 90 is stamped to include a generally rectangular outer cut out 98 and an elongate inner oval cut out 100. These punches generally define the base 18 and parallel cantilever beams 26 and 28. The material remaining between cut outs 98 and 100 defines an inner pair of spring arms 56 and 58. The two pairs of parallel beams, 26 and 28 and 56 and 58, are interconnected in tandem at the front end 82 by linking elements 46 and 48. The carrier attachment projections 52 in the blank 90 are interconnected at a forward end 102. The forward end 104 of oval cut out 100 extends beyond the linking members 46 and 48 into the forward carrier attachment portions of blank 90. The enlarged rectangular projection 106 formed by the interconnected carrier attachment ribs 52 is provided at the front end 82 of blank 90 to permit clamping members in the forming apparatus to hold the front end 82 during forming operations.

In the center portion of FIG. 7, a partially formed intermediate terminal blank assembly 108 is shown. Intermediate assembly 108 has been impacted by tooling dies to define a rearward pair of parallel grooves 110 and a forward pair of parallel grooves 112 to define fold lines in the intermediate blank assembly 108 prior to forming up the contact 16.

Intermediate assembly 108 has also been contacted by forming dies to define the convex contact surfaces 34 and 36 and the anti-stubbing surfaces 38 and 40 in outer cantilever beams 26 and 28. The contact surfaces 34 and 36 have been relatively raised upwardly from the plane of the blank 90 at this intermediate stage 108 which permits selective plating of the contact surfaces 34 and 36 to be performed by brush plating or other conventional plating methods. In the alternative, pre-plated stock may be used in forming either terminal blank 90 or intermediate blank assembly 108.

In the right hand portion of FIG. 7, pin-receiving terminal 80 has been formed by folding up the outer portions of intermediate assembly 108 along grooves 110 and 112 to define the generally U-shaped configuration of pin-receiving contact 16. Thereafter, the front end 12 of contact 16 is formed by severing rectangular projection 106 behind the front end 104 of oval cut out 100 to provide the separated pin-receiving ends 30 and 32 in beams 26 and 28. It should be understood that the secondary carrier strip 94, instead of being defined at the rear end of blank 90, could also be defined at an intermediate portion of blank 90, such as at a point rearwardly adjacent base portion 18.

The new and improved pin-receiving contacts 16 of the present invention, are useful for making improved receptacle connectors for electrically mating pin connectors with another circuit member. More particularly, and referring now to FIG. 8, a new and improved connector arrangement 120 is shown. Connector arrangement 120 is provided for connecting a plurality of discrete insulated wire leads 122, to conductive regions or printed circuits 124 defined on a printed circuit board 126.

Connector arrangement 120 includes a right angle pin header connector 128, which is mounted on a surface of printed circuit board 126, adjacent to an edge thereof. Right angle pin-header connector 128 is seen to include a dielectric header housing 130, having a mating end 132 and an opposed rear end, 134. Header housing 130 is provided with a board engaging surface 138, and an opposed top surface 136. Header housing 130 is also provided with a pair of opposed side surfaces 140, each including a lock projection 142, as shown.

Pin header connector 128 also includes a plurality of rectangular pin terminals 144, as shown. Each pin terminal 144, includes a tapered front rectangular contact portion 146 and a rearward solder tail contact portion 148. Solder tail contact portion 148 may be connected to individual circuits 124 on printed circuit board 126 by means of any conventional through-hole solder arrangement. A surface mount arrangement may also be employed in place of solder tails 148 as will be suggested to the skilled artisan.

Connector arrangement 120 additionally includes a receptacle connector 150, in accordance with the principles of the present invention. More particularly, receptacle connector 150 is seen to include a dielectric connector housing 152, having a forward mating end 154, and an opposed rear conductor-receiving end 156. A pair of resilient latch arms 158 extend forwardly from opposed sides of connector housing 152, which are adapted to lockingly releasably engage lock projections 142 for retaining connector housing 150 in mated relationship to pin header connector 128. Connector housing 152 further includes a plurality of terminal-receiving cavities 160 defined therein extending between rear conductor receiving end 156 of housing 152 and a pin-receiving aperture 162, defined in the forward mating end 154 of receptacle housing 152. Advantageously, a four-sided inwardly flared pin entry portion 164 is defined around the forward end of pin-receiving apertures 162, to provide an effective guiding lead in for directing the front pin contact portions 146, into pin-receiving apertures 152.

Figure 9:
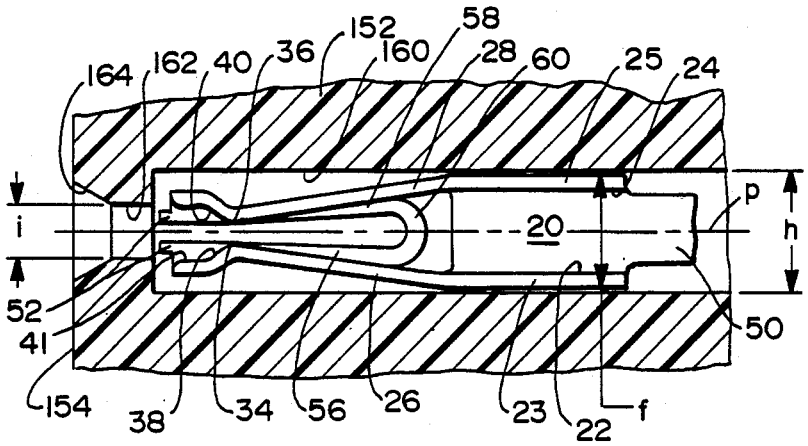
FIG. 9 is an elevated sectional view of the new and improved electrical receptacle connector of this invention taken along view line 9—9 of FIG. 8.
Figure 10:
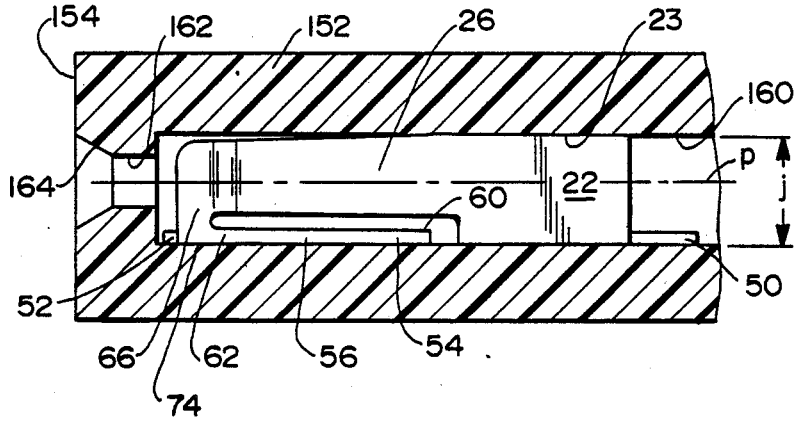
FIG. 10 is an elevated side sectional view of the new and improved electrical receptacle connector, taken along view lines 10—10 of FIG. 8.

Referring now to FIGS. 9 and 10, in the preferred embodiment depicted therein, the new and improved terminals 10, including the pin-receiving contact section 16 of the present invention are adapted for press-fit engagement within the terminal receiving cavities 160 of receptacle connector 150. More particularly, as shown in FIG. 9, the width, h, of the terminal receiving cavity 160 is designed to closely slideably receive the width, f, of the base 18. Moreover, the pin-receiving aperture 162 defined in the front end 154 has a cross-sectional dimension, i, which is selected to be narrower than the width dimension, g, at the front end of the terminal and preferably will be slightly smaller than the separation gap, e, provided at the front end of the terminal. This will insure that the front end 146 of the inserted pin terminals 144 will first wipingly engage the anti-stubbing surfaces 38 and 40 defined at the front end 12 of pin contact section 16. The relative dimensions of the lead-in 164 and the aperture 162 diameter, i, will help to positively control the possible mating misalignments of a pin terminal. As shown in FIG. 9, the terminal receiving cavity 160 and front pin-receiving aperture 162, are located so that as pin-receiving contact 16 is press-fit into cavity 160, the pin-receiving aperture 162 is coaxially aligned with the pin-receiving axis, p, of pin-receiving contact 16.

Referring now to FIG. 10, the height dimension, j, of terminal receiving cavity 160, is selected to permit the press fit engagement of pin-receiving contact 16. More particularly, height, j, is dimensioned for press-fit engagement by the upper surfaces 23 and 25 of upstanding legs 22 and 24, to positively retain the pin-receiving contact 16 at the appropriate location within terminal receiving cavity 160. The height dimension, j, of terminal receiving cavity 160 will be approximately the same as the height dimension, a, of the base 18 of pin-receiving contact 16. As is clearly shown in FIG. 10, the resilient beam support member 54 is disposed below the pin-receiving axis, p, and below housing aperture 162.

Figure 8:
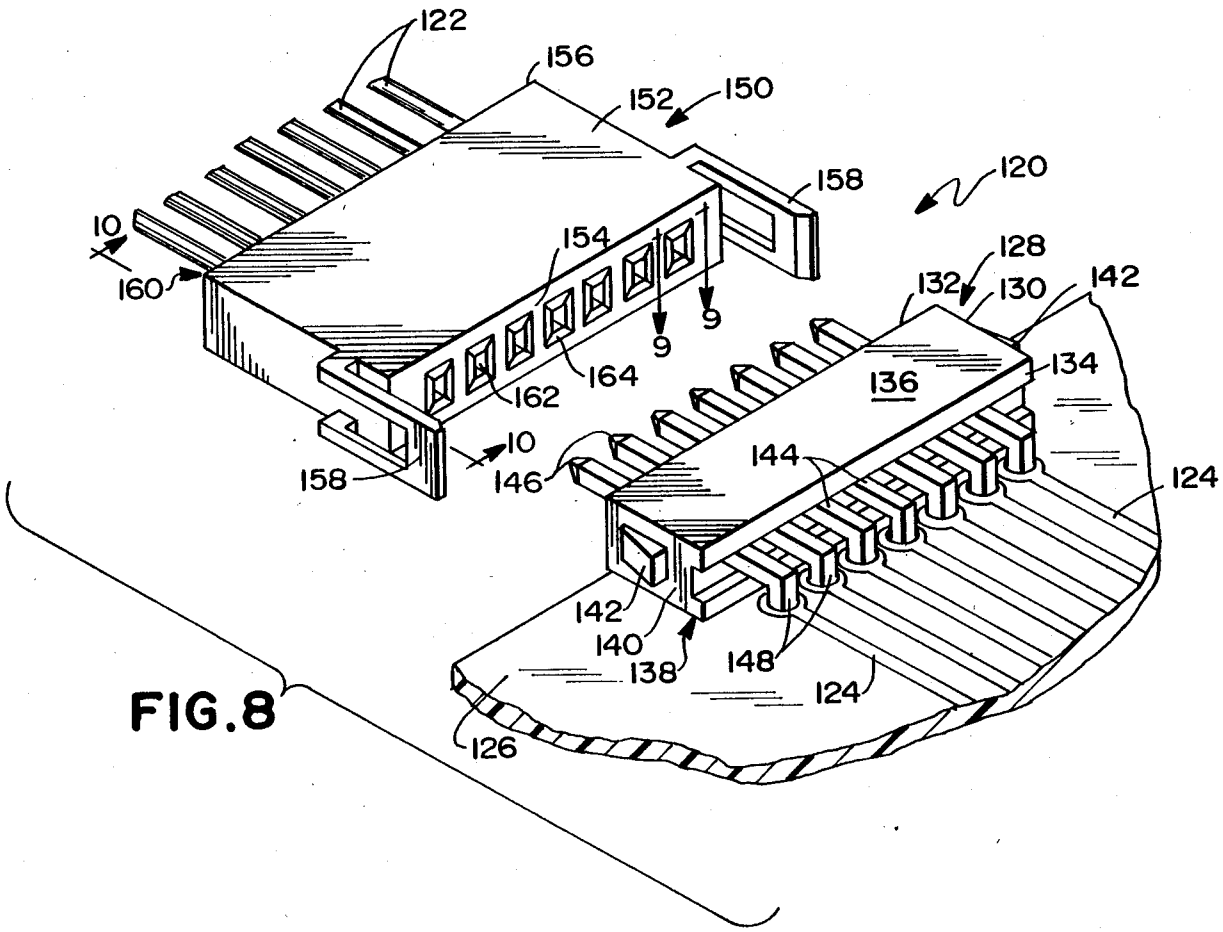
FIG. 8 is a perspective view of a new and improved electrical receptacle connector including the new and improved pin-receiving contacts of the present invention and shown in mating relation to a board-mounted rectangular pin header connector to illustrate one use of the pin-receiving contact of this invention.

In the connector arrangement 120 shown in FIGS. 8–10, the rearward conductor contact portions for electrically contacting the conductors of discrete wire leads 122 are not shown, but as will be apparent to those skilled in the art, may comprise a crimp contact section or an insulation displacement contact section or other suitable wire connection means. Moreover, instead of providing conductor contact portions for discrete wire leads 122 opposite pin-receiving contact sections 16, terminals 10 may also be provided with cable contact portions such as insulation pierce, insulation displacement or crimp. In addition, the receptacle connector 150 may also be a board mounted receptacle connector including terminals 10 having second contact portions selected from solder tail, surface-mount or circuit board contact types.

Figure 11:
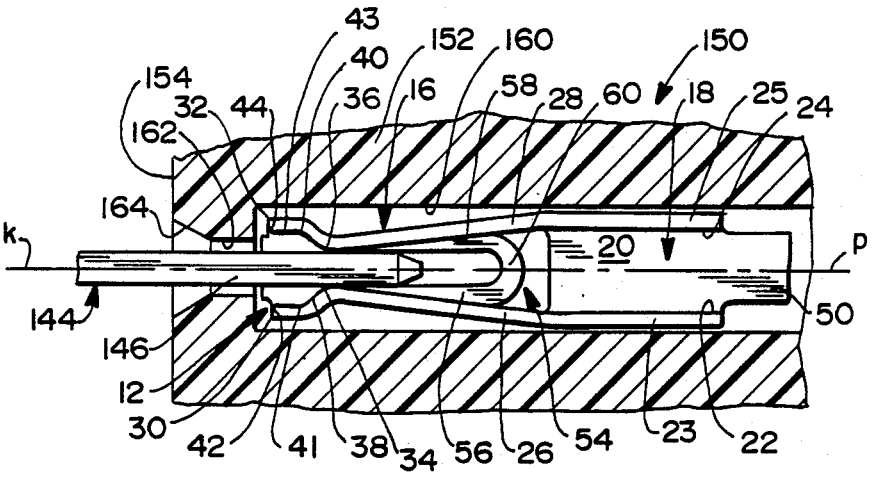
FIG. 11 is an elevated sectional view of the new and improved receptacle connector of this invention similar to FIG. 9 shown mated to an aligned pin terminal.
Figure 12:
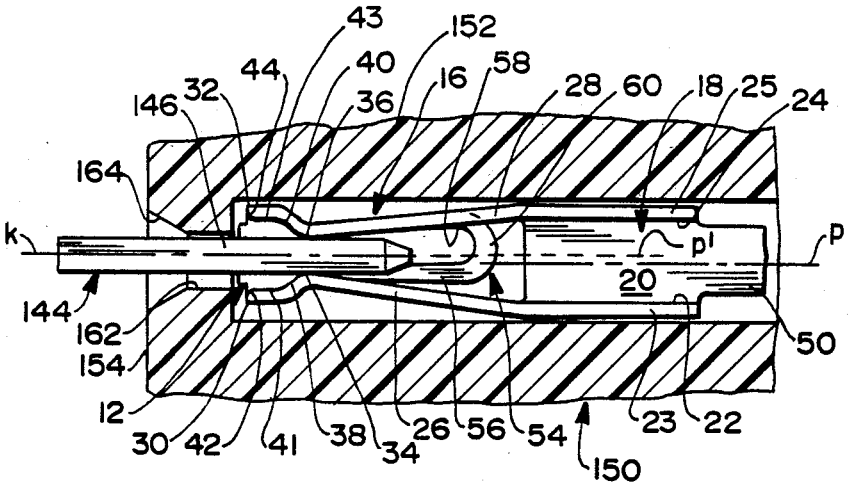
FIG. 12 is an elevated sectional view of the new and improved receptacle connector of this invention similar to FIG. 11 shown mated to a misaligned pin terminal.

Referring now to FIGS. 11–12, the new and improved receptacle connector 150, including the pin-receiving contacts 16, is shown in mated relationship to an inserted pin terminal, such as a pin terminal 144 of right angle pin header connector 128 shown in FIG. 8. In the mated condition shown in FIG. 11, the tapered front contact portion 146 of pin 144 has been inserted through pin-receiving aperture 162 provided in mating end 154 of housing 152. As depicted therein, pin terminal 144 has been inserted in an aligned manner so that the longitudinal axis, k, of the front contact portion 146 is aligned with the pin-receiving axis, p, of pin-receiving contact 16. During insertion of pin contact 146, the opposed side surfaces along the tapered front tip of the pin contact 146 engage anti-stubbing surfaces 38 and 40 of the cantilevered beams 26 and 28, respectively. Further pin insertion causes each of beams 26 and 28 to be outwardly deflected an equal amount with respect to pin-receiving axis, p, until their respective convex contact surfaces 34 and 36 are wipingly, slideably engaged on opposite sides of pin contact portion 146 at a location therealong spaced from the tapered tip. The early entry configuration ensures a long contact wipe on opposed sides of pin contact 146 for improved, electrical reliability. Moreover, as has been demonstrated above, in an aligned mating condition as shown in FIG. 11, each of cantilevered beams 26 and 28 may be outwardly displaced away from pin-receiving axis, p, by, for example, a wider four-sided pin or larger diameter pin before being overstressed, i.e., without yielding, as compared with prior art contact structures shown in FIGS. 1–3, which do not include the resilient beam support member such as 54.

In the mated condition shown in FIG. 11, pin insertion causes each cantilever beam 26 and 28 to elongate slightly and normal forces on the pin include a combination of forces contributed by each of beams 26 and 28, as well as spring arms 56 and 58 to which they are attached. Generally, pin-receiving contact 16 deforms symmetrically in the aligned insertion condition shown in FIG. 11, and the normal forces of each convex contact surfaces 34 and 36 on the opposed sides of pin contact section 146 are generally the same.

Referring now to FIG. 12, the pin-receiving contact 16 of receptacle connector 150 is shown mated to a misaligned pin terminal 144. More particularly, as shown in FIG. 12, the longitudinal axis, k, of pin contact portion 146 is laterally displaced or offset from the pin-receiving axis, p, of pin-receiving contact 16, which condition frequently occurs with multi-circuit connectors.

As mentioned above, the forward end 12 of contact 16 is provided with reduced dimensions b and g, which are smaller than the corresponding dimensions a and f of the base portion 18. In this manner, the front end 12 of contact 16 is provided with a sufficient amount of clearance between front end 12 and the forward end of terminal receiving cavity 160 to permit the front end of pin-receiving contact 16 to float in response to a lateral mating misalignment of an inserted pin contact 146. The width dimension, c, of each of cantilever beams 26 and 28 at their respective contact surfaces 34 and 36 is generally large enough to insure that any vertical misalignment of the pin axis, k, with respect to pin-receiving axis, p, of a pin inserted through aperture 162 will still make contact and cause contact surfaces 34 and 36 to be engaged onto the opposed sides of the inserted pin contact 146.

In the misaligned insertion condition shown in FIG. 12, the pin-contact axis, k, is laterally offset from pin-receiving axis, p. Cantilever beam 28 is displaced outwardly from its initial position to the final mated position shown by a greater amount than cantiever beam 26. At the early stages of insertion of the misaligned pin contact 146, the tip portion of pin contact 146 displaces cantilever beam 28 away from pin-receiving axis, p, toward the adjacent sidewall of housing cavity 160 by camming engagement with anti-stubbing surface 40. In the process, the elastic support member 54 and cantilever beam 26 travel or float in the same direction with the displaced beam 28. Further pin insertion causes generally simultaneous outward displacement of convex contact surfaces 34 and 36 until they are slideably engaged on the opposed parallel side surfaces of pin contact portion 146. Normal contact forces are developed by both beam contact surfaces 34 and 36. Expressed differently, the pin contact portion 16 shown in FIG. 12 has floated and the pin-receiving axis, p, of the contact has moved from an initial position to a laterally displaced position indicated as p′ in FIG. 12. The contact section 16 has floated as shown in FIG. 12 to meet the pin being inserted, so that the displaced pin-receiving axis p′ is more closely aligned with the offset pin contact axis, k. In this manner, due to the provision of the resilient support member linking cantilever beams 26 and 28 together and by designing front end 12 to have reduced dimensions with respect to the base 18, the new and improved pin-receiving contact 16 is permitted to float which allows the contact to become self-aligning with respect to the misaligned pin terminal being inserted for mating.

The self-aligning floating movement provides two important features for enhanced electrical contact reliability. Firstly, each beam 26 or 28 may be displaced farther without overstressing the beam because of the resilient beam support member 54. Therefore, the displacement and float shown in FIG. 12 does not cause an overstress to occur in beam 28.

Secondly, because the pin-receiving contact 16 floats to a new center, or new axis p′ in response to pin misalignment, further insertion of the pin causes deflection of both beams 26 and 28 so that normal contact loads are developed on both sides of the contact. The contact 16 of this invention provides a dual cantilever beam system which provides two points of redundant high normal force contact even in the misaligned mating condition shown in FIG. 12.

These advantageous properties of the contact of this invention are in sharp contrast to the prior art contacts shown in FIGS. 1–3. The prior art dual beam systems shown in FIGS. 1–3 generally are not designed to permit float, and if a base portion is provided which may permit some float, their contact configurations are such that it will not be a self-aligning float as is achieved with the present contact 16. More importantly, insertion of a misaligned pin into each of these prior art contact systems will cause displacement of only one cantilever beam, leaving the opposing beam to make little or no contact with the pin. As has been demonstrated above, even minor misalignments of the pin will cause the one beam contacted in these prior systems to be displaced beyond its minimum yield point. The displaced beam is therefore overstressed and responds inelastically to the misaligned insertion. As a result, poor normal contact forces of at least one of the two beams, and often both, are developed with the prior art contacts shown in FIGS. 1–3, in the misaligned mating condition shown in FIG. 12.

The ability of the new and improved elastically supported dual beam contact 16 to float and develop two points of high force contact against a mated pin terminal renders the present contact 16 and receptacle connectors 150 containing them especially useful in high vibration end use environments, such as in aircraft or automotive applications. In these contexts, the two high pressure points of contact provided by contact 16 of this invention, are expected to provide a significant reduction in fretting corrosion due to environmental vibrations.

As will be appreciated by those skilled in this art, both the amount of float and the normal force load applied at each convex contact surface 34 or 36 after float will be related to the relative spring rates of cantilever beams 26 and 28 on the one hand and the spring rates of spring arms 56 and 58 on the other. For example, if the resilient support member 54 is designed to be a stiff spring system so that spring arms 56 and 58 have a high spring rate and each of cantilever beams 26 and 28 are designed to have a lower relative spring rate, the contact section would be expected to float readily and the normal force loads on each side of the pin after float would approach being equal to one another. However, the maximum range of float in one direction would have to be carefully controlled so that the cantilever beam lying on the side of the contact which is in the direction of the float is not overdeflected beyond its yield point. Alternatively, if the contact is designed so that the cantilever beams 26 and 28 have a higher spring rate than spring arms 56 and 58 the contact will have a broader float range, however, the normal load applied by the following cantilever beam would not be equal to the displaced beam. In the preferred embodiment having the configuration shown in FIGS. 4–12 herein, the pin-receiving contact 16 was designed primarily to provide a contact having the broadest possible elastic deflection range which still meets minimum contact load requirements. Accordingly, the spring rate ratio of beams 26 and 28 compared with the spring rate of spring arms 56 and 58 for this embodiment was selected to be at least about 2:1. For other applications however, normal force loads may be relatively more important than the elastic response range to mating displacements. In these circumstances, the spring rate ratio may be reversed, e.g. 1:2.

In a unitary stamped and formed contact such as contact 16 which is stamped from uniform thickness sheet metal stock, one method for varying the relative spring rates of beams 26 and 28 with respect to spring arms 56 and 58 is to vary the relative lengths of the beams or arms with respect to each other. For example, by shortening the length of spring arms 56 and 58 defined between the front end 12 and bight portion 60 of resilient support member 54, a higher spring rate for spring arms 56 and 58 relative to cantilever beams 26 and 28 may be achieved. These design variations will be readily appreciated by those skilled in this art.

Although the present invention has been described with reference to certain preferred embodiments, modifications or changes may be made therein by those skilled in the art. For example, although the present invention has been described as having particular usefulness in the field of miniature pin and receptacle contacts, the new and improved pin-receiving contact section 16, may also be used in larger pin-receiving contact situations. Although the miniature contacts of the preferred embodiment were described as being stamped and formed from a phosphor bronze sheet metal stock material, it is expected that if the contacts were stamped and formed from other grades of sheet metal stock including beryllium coppers, the overall performance advantages provided by the new and improved contact structure will only be further enhanced.

Although in the preferred embodiment shown herein, the resilient beam support member 54 was provided with a U-shaped configuration, other resilient beam support member configurations will also suggest themselves to those skilled in the art. For example, beam support member 54 instead of being U-shaped, might also be W-shaped or C-shaped. In addition, beam support member 54 may be connected in tandem to the front ends of the cantilevered beams 26 and 28, in a nonparallel manner, depending on the particular connector application of use. For example, the beam support member may possibly extend normal to the pin-receiving axis or in still other applications it may be possible to provide the resilient beam support member parallel to the pin-receiving axis but extending forwardly from the front ends of the cantilever contact beams 26 and 28. The particular advantage shown by providing the resilient support member as parallel to the pin-receiving axis, is that it does not require additional space to be provided in a connector, in order to receive the new and improved pin-receiving contact terminals.

Moreover, in the preferred embodiment shown, the base 18 and cantilevered contact beams 26 and 28 define a generally U-shaped structure adapted to receive rectangular or round pins. If a pin-receiving contact is required for mating with rectangular or square pins only, then the pin-receiving structure including the base 18 and contact beams 26 and 28 instead of being an upstanding U-shape may be modified to be a planar U-shaped configuration more closely resembling a tuning fork type configuration.

Furthermore, although in the preferred embodiment shown in FIGS. 8–10, the terminals and housing cavities were designed to provide press-fit engagement or mounting of the terminals within the housing cavities, other known terminal retention methods may be substituted. For example, barbs could be provided on upstanding leg surfaces 23 and 25 so that the terminal skives against the cavity sidewall to provide retention. Alternatively, locking lances struck out from a terminal wall portion adapted to lockingly engage a latch recess or shoulder in the housing cavity may be used. In addition, unitary or separate housing parts may be engaged within or onto the receptacle housing which may include a lock projecting member positionable behind a terminal edge to retain the terminal in the housing cavity. Furthermore, the terminals may be insert molded into a subassembly which may in turn be loaded into the connector housing. Any terminal retention means or terminal position assurance means known to those skilled in this art may find application herein as well.

Finally, in the above description, the resilient beam support member 54 has been discussed generally in connection with dual cantilever beam systems which are generally symmetrical and balanced, wherein both beams are designed to be generally simultaneously outwardly deflected by mating insertion of a pin terminal therebetween. In some design applications, however, it may be advantageous to provide a relatively one-sided system including a first relatively rigid or non-deflectable beam or plate member and a second opposed flexible beam which undergoes most or all of the deflection upon pin insertion. The advantages provided by a resilient beam support member in accordance with this invention are expected to apply to these one-sided systems as well. Accordingly, the provision of a resilient beam support member extending from and interconnecting the pin-receiving end of the second flexible beam to the first rigid beam or plate member in such a one-sided contact system is expected to significantly increase the elastic response range of the contact to greater outward displacements while providing increased normal contact forces against an inserted pin.

All such obvious modifications may be made herein by those skilled in the art, without departing from the scope and spirit of the present invention as defined by the appended claims.

We claim:

1. A method for making a metallic terminal including a pin-receiving contact portion, said method comprising the steps of:

stamping sheet metal stock to define at least one terminal blank including a base portion, a first outer pair of parallel beams extending from opposed sides of said base portion to a forward end, a second inner pair of arms extending between said first pair of beams, said inner arms being joined together at one end adjacent to the base by a bight portion and the opposed end of each of said inner arms being connected in tandem to the forward end of its adjacent outer beam by a linking element;

forming a contact portion on each of said outer beams; and thereafter, forming up the opposed sides of said blank to form a U-shaped member such that the contact portions of said beams are positioned to slideably receive and electrically engage an inserted male pin terminal.

2. A high contact force, high elastic response range pin-receiving electrical terminal (10) including: a channel-shaped base member (18) joining a forward pin engaging structure with a generally box-shaped pin receiving region, therebetween, said pin engaging structure having a pair of spaced apart cantilever beams (26, 28) extending forwardly of said base member (18) to generally define opposed sides of said box-shaped region, each beam (26, 28) having a pin contacting surface (34, 36) facing the opposed beam for slidably engaging an inserted pin terminal, the improvement comprising:

a resilient beam support member (54) extending between and mechanically interconnecting the forward, free ends (30, 32) of said beams (26, 28) to generally define a third side of said box-shaped region.

3. A pin-receiving terminal (26, 28) as in claim 2 wherein the contact surfaces (34, 36) of said beams (26, 28) are in opposition and disposed adjacent to the pin-receiving ends of the beams (34, 36) to define an early entry pin-receiving contact (16).

4. A pin-receiving terminal as in claim 2, wherein said base (18) has a U-shaped cross section including a pair of legs (22, 25) upstanding from a bight portion (20) and said cantilevered beams (26, 28) extending forwardly from said legs, respectively.

5. A pin-receiving terminal as in claim 4, wherein said beam support member (54) comprises a U-shaped spring including, spring arms (62, 64) extending from said forward pin receiving end (30, 32) of said beams (26, 28) to join an interconnecting bight portion (60).

6. A pin-receiving terminal (10) as in claim 5, wherein said spring arms (62, 64) extending rearwardly from said forward pin-receiving ends (30, 32) of said beams (26, 28) past said pin contacting surfaces (34,36).

7. A pin-receiving terminal as in claim 6, wherein the pin-receiving ends (30 32) of said cantilever beams (26, 28) are connected to the opposed ends of said spring arms (62,64) respectively by a pair of L-shaped linking elements (46, 48).

8. A pin-receiving terminal as in claim 2, comprising a unitary metallic contact.

* * * * *